US005285974A

United States Patent [19]

Cesarini

[11] Patent Number: 5,285,974

[45] Date of Patent: Feb. 15, 1994

[54] TWO-PIECE HAMMER FOR USE IN A SHREDDER

[75] Inventor: Michael Cesarini, Pulaski, Tenn.

[73] Assignee: American Magotteaux Corp., Nashville, Tenn.

[21] Appl. No.: 777,173

[22] Filed: Oct. 16, 1991

[51] Int. Cl.[5] ..... B02C 13/00

[52] U.S. Cl. ..... 241/194; 241/197; 241/DIG. 30

[58] Field of Search ..... 241/193-195, 241/197, DIG. 30, 292.1, 291

[56] References Cited

U.S. PATENT DOCUMENTS 2,467,865 4/1949 Smith ..... 241/194 X
4,319,719 3/1982 Larsen ..... 241/DIG. 30
5,114,085 5/1992 Inui ..... 241/197

*Primary Examiner*—Douglas D. Watts
*Attorney, Agent, or Firm*—Longacre & White

[57] ABSTRACT

A two-piece hammer for use in a shredder comprises a work engaging piece made from a hard, wear resistant material and a supporting piece made from a softer, relatively ductile material having a relatively high tensile strength. The two pieces are secured together by a removable fastener, with a resilient member being interposed between the work engaging piece and a supporting flange of the supporting piece to dampen the transmission of impact forces from the work engaging piece to the supporting piece. The supporting piece comprises an aperture which is adapted to receive a support pin of the shredder when the hammer is mounted in the shredder.

19 Claims, 2 Drawing Sheets

TWO-PIECE HAMMER FOR USE IN A SHREDDER

BACKGROUND OF THE INVENTION

1. Field of the Invention

This invention pertains to the field of hammers adapted to be used in shredders. More particularly, this invention pertains to the field of two-piece hammers adapted to be used in industrial shredders.

2. Description of the Related Art

Industrial shredders have become essential equipment in many processing and manufacturing facilities including paper recycling plants, pulp processing plants, and refuse derived fuel (RDF) plants. These shredders conventionally employ a plurality of hammers pivoted on a motor-driven rotor which are adapted to shred or crush materials which are fed through the shredder.

Conventional hammers include "bell" shaped hammers and "bowtie" shaped hammers. Each of these conventional hammers is formed as one piece (e.g. through a casting and/or machining process) from a homogeneous material. In the prior art, this material is selected so as to have sufficient hardness to prevent excessively rapid wear at the hammer tip and sufficient ductility and tensile strength to prevent the hammer from shattering during the shredding operation. However, the selection of this material often involves a compromise between hardness and ductility. Moreover, when these hammers wear out or fail, it becomes necessary to disassemble the shredder to replace the entire hammers.

SUMMARY OF THE INVENTION

It is an object of the invention to provide a two-piece hammer for use in a shredder having a work engaging portion and a supporting portion secured together by a removable fastener, wherein the work engaging portion can be removed from the supporting portion without removing the hammer from the shredder.

It is another object of the invention to provide a two-piece hammer for use in a shredder wherein the work engaging portion is made of a material which is harder than that of the supporting portion, whereby the working life of the hammer can be extended by reducing the wear at the work engaging portion.

It is another object of the invention to provide a two-piece hammer for use in a shredder wherein a resilient layer is interposed between the work engaging portion and the supporting portion so as to dampen an impact load exerted on the supporting portion by the work engaging portion during a shredding operation.

It is another object of the invention to provide a two-piece hammer for use in a shredder wherein the work engaging portion comprises two symmetrical work engaging faces, and wherein means are provided for reversing an orientation of the work engaging portion so as to selectively present either one of the two work engaging faces to impact against the material to be shredded.

It is another object of the invention to provide a two-piece hammer for use in a shredder wherein the work engaging portion is supported on a supporting face of the supporting portion and wherein the supporting face is substantially perpendicular to the direction of the force of impact during shredding, whereby the force of impact is absorbed in the supporting face(s) so as to minimize the impact load carried by the removable fastener.

Specifically, the invention comprises a hammer, for use in a shredder including a supporting portion comprising a first end which includes an aperture adapted to receive a support pin of the shredder and a second end which includes a support flange; a work engaging portion; and removable fastener means for removably fastening the work engaging portion to the support flange, wherein the work engaging portion is made from a first material and the supporting portion is made from a second material, and wherein the first material is harder than the second material.

In other aspects, the invention comprises a hammer, for use in a shredder, including a supporting portion comprising a first end which includes an aperture adapted to receive a support pin of the shredder and a second end which includes a support flange; a work engaging portion; removable fastener means for removably fastening the work engaging portion to the support flange; and a resilient member interposed between the supporting portion and the work engaging portion, wherein the resilient member is adapted to dampen an impact load transmitted from the work engaging portion to the supporting portion during an operation of the shredder and to maintain a tension on the support bolt during operation, thereby reducing a fatigue loading on the bolt.

In still other aspects, the invention comprises a hammer, for use in a shredder, including a supporting portion comprising a first end which includes an aperture adapted to receive a support pin of the shredder and a second end which includes a support flange; a work engaging portion; and removable fastener means for removably fastening the work engaging portion to the support flange; wherein the support flange includes a generally planar support face which supports the work engaging portion, and wherein an angle is defined between a plane of the support face and a line extending between a center of the aperture and a center portion of the support face, wherein the angle is between approximately 10 and 25 degrees.

The invention will, however, be best understood by reviewing the following specification in conjunction with the accompanying drawings, in which:

DETAILED DESCRIPTION OF THE PREFERRED EMBODIMENT

Figure 1:
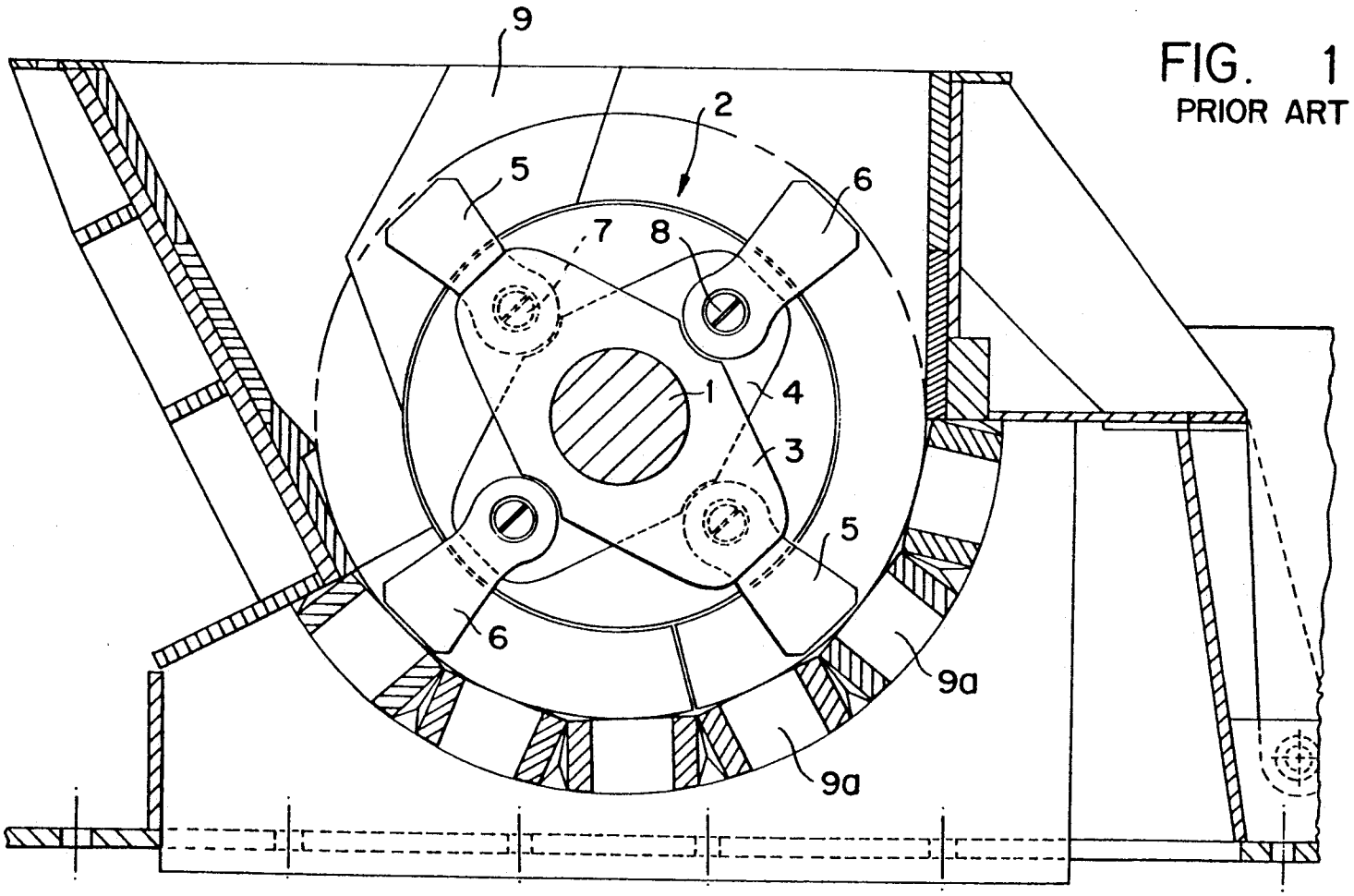
FIG. 1 PRIOR ART
FIG. 1 is a sectional view of a conventional shredder having "bell" shaped hammers.

A conventional shredder is shown in FIG. 1 and comprises a drive shaft 1 which drives a rotor 2. The rotor 2 comprises a plurality of (e.g. eleven) axially spaced lobes 3, 4 which are each keyed to the shaft 1 and which are axially positioned along the drive shaft 1 in an alternating fashion (e.g. so that each lobe 3 is sandwiched by a pair of lobes 4, and vice-versa). Hammers 5, either of "bell" or "bow tie" shape, are secured for rotation with the lobes 3, while hammers 6 are secured for rotation with the lobes 4. Specifically, pivot pins 7 extending parallel to the shaft 1 are received within apertures provided in radially outer portions of each of the lobes 3, and each of the hammers 5 is itself provided with an aperture through which the respective pivot pin 7 extends. Thus, each of the hammers 3 are sandwiched between a pair of the lobes 5 and are pivotable on one of the pins 7. Similarly, pivot pins 8 extending parallel to the shaft 1 are received within apertures provided in radially outer portions of each of the lobes 4, and each of the hammers 6 is itself provided with an aperture through which the respective pivot pin 8 extends. This structure is conventional and is shown and described in more detail in U.S. Pat. Nos. 3,465,973 and 3,667,694, herein incorporated by reference.

The operation of the shredder of FIG. 1 is as follows. As the shaft 1 drives the rotor 2, material to be crushed or shredded is dropped into the shredder body 9. As the material approaches the rotor 2, the revolving hammers 5, 6 impact upon the material, thereby crushing and/or shredding the material. The crushed and/or shredded material then passes between the revolving rotor 2 and the shredder body 9 and falls through the discharge openings 9*a*, whereby the crushing and/or shredding operation is completed.

Figure 3:
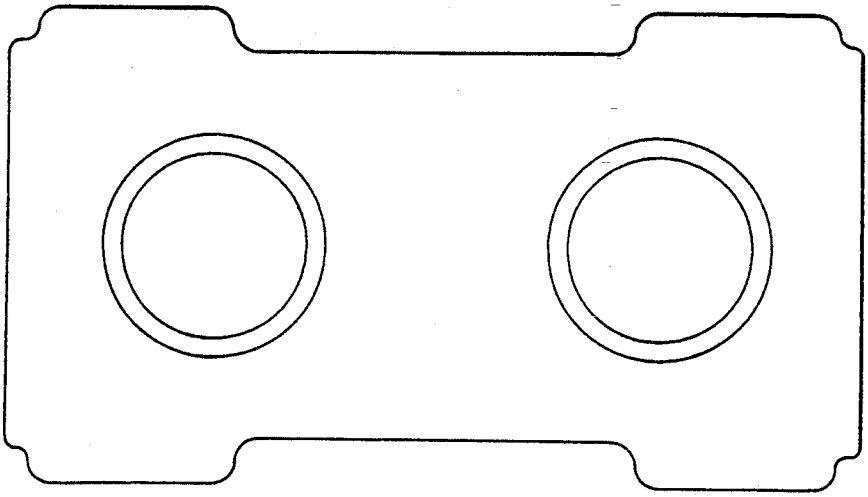
FIG. 3 is a side view of a conventional "bow tie" shaped hammer.
Figure 2:
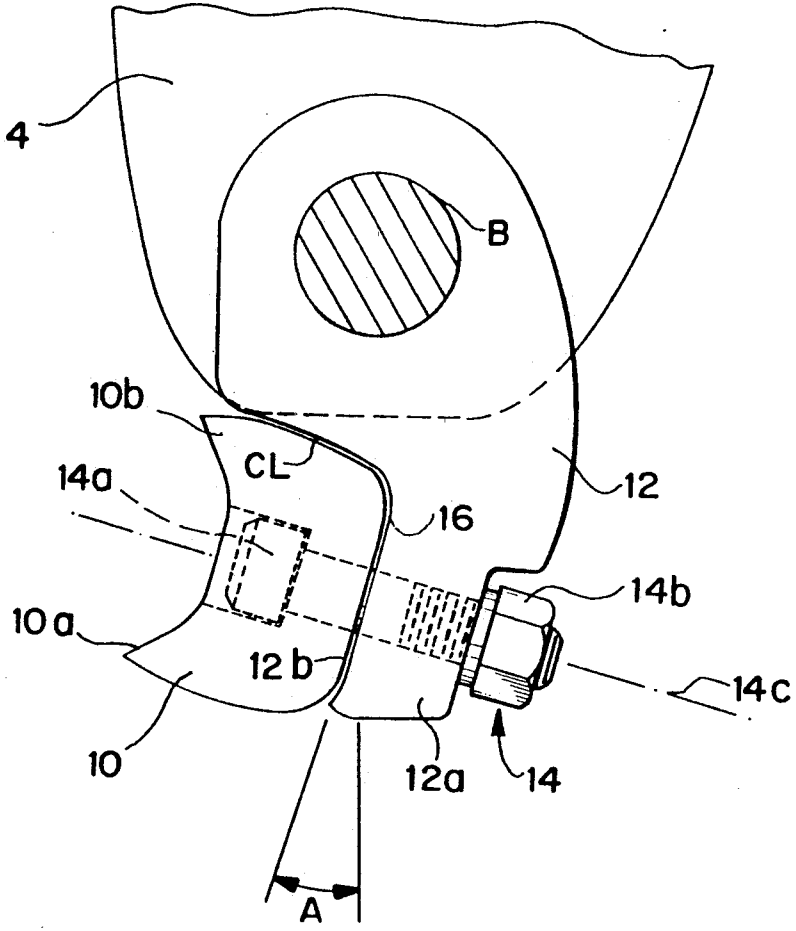
FIG. 2 is a side view of a two-piece hammer according to the invention for use in the shredder of FIG. 1.

According to the invention, there is shown in FIG. 2 an improved two-piece hammer for use in the shredder of FIG. 1. Specifically, a plurality of these two-piece hammers replace the hammers 5, 6 shown in FIG. 1, and are connected for rotation with the rotors 3, 4 via the hammer support or pivot pins 7, 8 respectively. A connection between a two-piece hammer and one of the rotors is shown in FIG. 2. The remainder of the two-piece hammers are similarly connected to the rotors. (It should be understood, however, that the use of the two-piece hammer of FIG. 2 in the shredder of FIG. 1 is exemplary only; according to the invention, the two-piece hammer may be employed in any suitable shredder. Moreover, the two-piece hammer according to the invention may replace other kinds of hammers, such as the "bow-tie" hammer shown in FIG. 3.)

The two-piece hammer includes a work engaging portion 10 secured to a supporting portion 12 via a removable fastener 14. The supporting portion 12 comprises a first end which includes an aperture in which the hammer support or pivot pin 8 is received and a second end which includes a support flange 12*a*. In FIG. 2, the removable fastener 14 comprises a bolt 14*a* having a head portion sunk into the work engaging portion 10 and a nut 14*b* received on a threaded end of the bolt 14*a*, whereby the work engaging portion 10 of the two-piece hammer is clamped to the support flange 12*a* of the supporting member 12 by the threaded fastener 14. (A lock washer may be employed between nut 14*b* and the flange 12*a*.)

The work engaging portion 10 is substantially symmetrical about a plane extending through the longitudinal center or axis 14*c* of the fastener 14 in a direction parallel to the pivot pin 8. Therefore, the work engaging portion defines a pair of cutting tip portions 10*a*, 10*b* which can alternately be positioned to engage the material to be shredded or crushed. Specifically, in the position shown in FIG. 2, the tip 10*a* constitutes the material engaging tip and is therefore subject to wear during extended shredding or crushing operations. After substantial wear has occurred at the tip 10*a*, the fastener 14 is removed from the hammer, the work engaging portion is rotated 180 degrees about the axis 14*c* and the fastener 14 is then replaced and tightened. Thus, the tip 10*b* will now constitute the work engaging tip and the useful life of the work engaging portion can almost be doubled.

According to the invention, a resilient shock absorbing member 16 (e.g. a layer of rubber or other elastomer) is interposed between the work engaging portion 10 and a face 12*b* of the support flange 12*a* so as to cushion an impact force on the supporting member from the work engaging member during shredding. The face 12*b* of the supporting member is generally (e.g. substantially) planar and is arranged so as to define an small angle A (e.g. between about 10 and 25 degrees, and preferably 15 degrees) with a line extending radially outwardly from a center portion of the supporting pin 8 so as to pass through the support face at a center portion thereof. (The angle A is defined in a plane perpendicular to the plane of the support face.) Moreover, a small clearance CL (e.g. between 1 and 2 mm) is provided between the surface of the work engaging member 10 nearest the pin 8 and the adjacent surface of the supporting member (e.g. to allow a minimal freedom of movement between the work engaging portion 10 and the supporting portion 12 as the resilient material is compressed). In this arrangement, when the work engaging portion 10 impacts against a piece of material to be shredded or crushed, the impact load is transmitted from the work engaging portion 10 to the supporting member 12 in an attenuated fashion (due to the presence of the resilient member 16), whereby the load carried by the fastener during the shredding or crushing operation is limited primarily to the static tensile preload of the fastener.

The two-piece hammer may be manufactured in any desired size (e.g. 10 to 20 inches in length) and of any suitable material (e.g. steel, cast iron, etc.) by any suitable method (e.g. casting, machining, etc.). It is desireable, however, to form the work engaging portion from a material having a relatively high hardness (e.g. greater than Rc 48; preferably Rc 52 to Rc 65) so as to reduce an amount of wear which occurs at the material engaging tips 10*a*, 10*b* during the shredding or crushing operations. On the other hand, the supporting portion may be manufactured from a material having a relatively low hardness (e.g. less than Rc 40; preferably Rc 30 to Rc 37) so as to reduce wear of the supporting pin 8 (which pin is usually made from a material having an intermediate hardness, e.g. Rc 42). Moreover, the material of the supporting portion 12 may be selected to have good ductility, toughness, and tensile strength characteristics with out compromising the wear resistance characteristics of the tips 10*a*, 10*b* of the work engaging portion 10.

The resilient member 16 is preferably made of rubber and is between 1/32 and 5/32 inch thick, with 1/16 inch being a preferred thickness. The hardness of the material for member 16 is in the range of 20–80 shure, an intermediate hardness of 60 being most suitable. The necessary performance characteristic of the resilient member is to absorb shock throughout a range of machine operating conditions and temperatures.

Numerous benefits are realized by the use of the two-piece hammers according to the invention. Specifically, the work engaging portion 10 can be made from harder material than that used in conventional hammers, thereby decreasing wear and increasing the expected life of the hammers. Once wear has occurred in the hammers and replacements become necessary, the servicing procedure merely involves manipulating the fasteners 14 and replacing (or reorienting) the work engaging portions 10 of the hammers; disassembly of the shredder by removal of the pins 7, 8 is no longer necessary. Furthermore, since the weight of the work engaging portion 10 is typically only 25% of the total weight of the hammer, the servicing (e.g. replacement) procedure is facilitated. Moreover, since the average weight loss per hammer (i.e. due to a wearing away of the hammer material at the work engaging portion) is 15 to 30 pounds, the weight loss/replacement weight ratio is significantly higher for the two-piece hammer according to the invention than for conventional "bell" or "bow tie" shaped hammers.

Although the hammer in FIG. 2 is best suited for a shredder having a driving shaft which rotates in a single direction, it will be apparent that, for a reversible shredder, a three-piece hammer may be manufactured according to the teachings of this specification. Specifically, work engaging portions may secured to either side of a support flange (so as to sandwich the support flange) by a removable fastener in such a manner that each longitudinal end of the removable fastener is located within a recess provided in one of the work engaging portions. In this arrangement, four possible work engaging tips (e.g. two on each work engaging portion) would provided on the hammer as the driving shaft rotates in forward and reverse directions.

While the present invention has been described in particular detail, it is not meant to be limited to the disclosed embodiments. Therefore the present invention will encompass the disclosed embodiments and any modifications thereof which will fall within the scope of the appended claims.

What is claimed is:

1. A hammer, for use in a shredder, comprising:

a supporting portion comprising a first end which includes an aperture adapted to receive a support pin of the shredder and a second end which includes a support flange;

a work engaging portion comprising a plurality of cutting surfaces; and removable fastener means for removably fastening the work engaging portion to the support flange, wherein the work engaging portion is made from a first material and the supporting portion is made from a second material, and wherein the first material is harder than the second material, said first material having a hardness of Rc 48 to Rc 65 and said second material having a hardness of Rc 30 to Rc 40, and a resilient member is interposed between the work engaging portion and the supporting portion so as to dampen an impact of a force transmitted from the work engaging portion to the supporting portion and to help maintain tension on the removable fastener means.

2. A hammer as recited in claim 1, wherein the first material has a hardness above Rc 52 and the second material has a hardness less than Rc 37.

3. A hammer as recited in claim 1, wherein the support flange includes a generally planar support face which supports the work engaging portion, and wherein the generally planar support face is substantially perpendicular to the direction of the force of impact during shredding, whereby the force of impact is substantially absorbed by the support face so as to minimize the impact load carried by the removable fastener and substantially maintain the work engaging portion in compression during shredding.

4. A hammer as recited in claim 1, wherein the work engaging portion is substantially symmetrical about a plane extending through an axis of the removable fastener means, wherein the work engaging portion comprises a pair of cutting tips, and wherein one of the cutting tips is located on each side of the plane.

5. A hammer as recited in claim 1, wherein the resilient member comprises a flexible sheet of between 1/32 and 5/32 inch thick; and having a shure hardness of between 20 and 80.

6. In combination, a hammer as recited in claim 1 and a hammer support pin connected to a rotor of a shredder, wherein the hammer support pin is received within the aperture in the supporting portion of the hammer.

7. A hammer, for use in a shredder, comprising:

a supporting portion comprising a first end which includes an aperture adapted to receive a support pin of the shredder and a second end which includes a support flange; a work engaging portion;

removable fastener means for removably fastening the work engaging portion to the support flange; and a resilient member interposed between the supporting portion and the work engaging portion, wherein the resilient member is adapted to dampen an impact load transmitted from the work engaging portion to the supporting portion during an operation of the shredder.

8. A hammer as recited in claim 7, wherein the support flange includes a generally planar support face which supports the work engaging portion, and wherein the generally planar support face is substantially perpendicular to the direction of the force of impact during shredding, whereby the force of impact is absorbed by the support face so as to minimize the impact load carried by the removable fastener and substantially maintain the work engaging portion in compression during shredding.

9. A hammer as recited in claim 8, wherein the removable fastener means extends in a direction substantially perpendicular to the plane of the support face.

10. A hammer as recited in claim 9, wherein a small clearance is provided between a surface of the work engaging portion nearest to the aperture and an adjacent surface on the supporting member.

11. A hammer as recited in claim 10, wherein the clearance is between 1 and 2 mm.

12. A hammer as recited in claim 7, wherein the supporting portion has a hardness of Rc 30 to Rc 40, and wherein the work engaging portion has a hardness of Rc 48 to Rc 65.

13. In combination, a hammer as recited in claim 7 and a hammer support pin connected to a rotor of a shredder, wherein the hammer support pin is received within the aperture in the supporting portion of the hammer.

14. A hammer, for use in a shredder, comprising:

a supporting portion comprising a first end which includes an aperture adapted to receive a support pin of the shredder and a second end which includes a support flange;

a work engaging portion; and removable fastener means for removably fastening the work engaging portion to the support flange, wherein the support flange includes a generally planar support face which supports the work engaging portion, and wherein an angle is defined between a plane of the support face and a line extending between a center of the aperture and a center portion of the support face, wherein the angle is between 10 and 25 degrees, and the generally planar support face is substantially perpendicular to the direction of the force of impact during shredding, whereby the force of impact is absorbed by the support face so as to minimize the impact load carried by the removable fastener and substantially maintain the work engaging portion in compression during shredding.

15. A hammer as recited in claim 14, wherein the removable fastener means extends in a direction substantially perpendicular to the plane of the support face.

16. A hammer as recited in claim 14, wherein the angle is substantially equal to 15 degrees.

17. A hammer as recited in claim 14, wherein the supporting portion has a hardness of Rc 30 to Rc 37 and the work engaging portion has a hardness of Rc 52 to Rc 65.

18. In combination, a hammer as recited in claim 14 and a hammer support pin connected to a rotor of a shredder, wherein the hammer support pin is received within the aperture in the supporting portion of the hammer.

19. A hammer as recited in claim 7, wherein the resilient member is a flexible sheet having a hardness of approximately 60–80 shore.

* * * * *